US005323507A

United States Patent [19]

Tosato

[11] Patent Number: 5,323,507

[45] Date of Patent: Jun. 28, 1994

[54] DEVICE FOR SURFACE CLEANING

[76] Inventor: Albano Tosato, Via A. Volta 18, Milan, Italy

[21] Appl. No.: 50,679

[22] Filed: Apr. 21, 1993

[30] Foreign Application Priority Data

Apr. 27, 1992 [IT] Italy ..... MI92 U 000427

[51] Int. Cl.[5] ..... A47L 13/46

[52] U.S. Cl. ..... 15/231; 15/257.01; 51/358; 51/388; 51/392

[58] Field of Search ..... 15/147.2, 229.13, 228, 15/231, 232, 257.01; 51/358, 364, 388, 391-393

[56] References Cited

U.S. PATENT DOCUMENTS

| | | | |
|---|---|---|---|
| 2,648,085 | 8/1953 | Rodgers . | |
| 2,666,224 | 1/1954 | Adams | 15/231 |
| 3,056,989 | 10/1962 | Murphy | 15/231 |
| 3,099,855 | 8/1963 | Nash | 15/231 |
| 4,031,673 | 6/1977 | Hagelberg | 51/392 |

FOREIGN PATENT DOCUMENTS

| | | | |
|---|---|---|---|
| 0295505 | 12/1988 | European Pat. Off. . | |
| 2153309 | 5/1973 | France . | |
| 140439 | 5/1953 | Sweden | 15/229.13 |
| 600761 | 4/1948 | United Kingdom | 15/147.2 |
| 651508 | 4/1951 | United Kingdom . | |
| 897556 | 5/1962 | United Kingdom . | |

*Primary Examiner*—Timothy F. Simone
*Assistant Examiner*—Mark Spisich
*Attorney, Agent, or Firm*—Hedman, Gibson & Costigan

[57] ABSTRACT

A device is disclosed for manually cleaning surfaces. The device has an angled tubular body having at one end an elastically deformable member with a central opening for holding a paper sheet. The paper sheet is affixed to the elastically deformable member by placing a sheet of paper over a stud on an associated paper support element and pressing a portion of the paper onto the central opening on the elastically deformable member. When it is necessary to change the sheet on the elastically deformable member, a flexible rod that is located coaxially within the tubular body, is used to eject the sheet by pressing on one end to cause the other end to pass through the elastically deformable member and contact the paper sheet.

11 Claims, 3 Drawing Sheets

DEVICE FOR SURFACE CLEANING

The present invention relates to an improved device for cleaning surfaces, such as, e.g., surfaces of sanitary fittings, glass sheets, floors, and so forth.

The purpose of the present invention is of providing a simple, cheap device which makes it possible the highest igienic conditions to be reached during its use, because the clening material is of a disposable type and is applied onto the device, and removed from it, with no need for any physical contacts.

These purposes are achieved by means of the present finding, which consists of a device for manually cleaning surfaces, which is characterized in that it comprises:

a tubular body with an axial bore, having an elbow-like bent end, and its other end provided with a portion which is at least partially mobile relatively to said tubular body;

a flexible organ housed inside the interior of said tubular body and axially mobile inside it, with said flexible organ being provided at one of its ends with an enlarged portion, and at its other end being connected with said mobile portion;

a support flange made of an elastically deformable material, mounted on said elbow-like bent end by means of a sleeve integral with said flange, with the latter being provided with a central opening lined-up with the hollow provided inside said sleeve;

a support provided with a flat surface from which a stud juts out, which stud has a shorter diameter then the transversal dimension of said opening and of said hollow provided in said flange, and having a rounded end.

The present finding is disclosed now in detail, by referring to the accompanying figures, in which.

Figure 6:
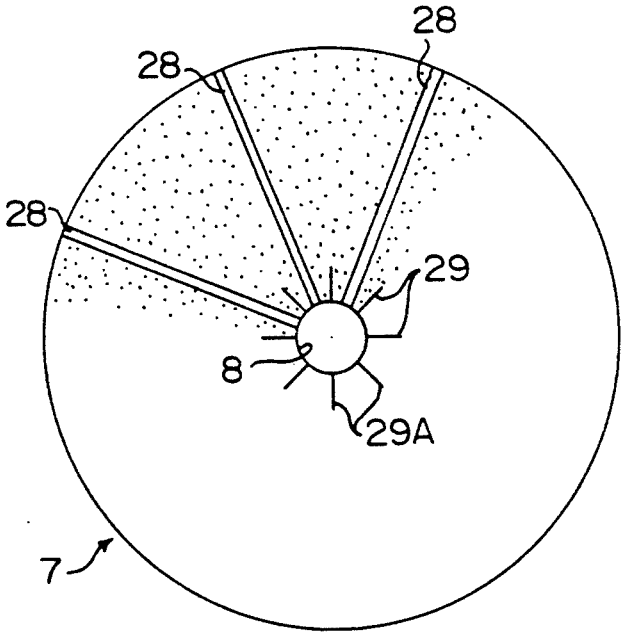

FIGS. from 3 to 5 illustrate the operating way of the device according to the present finding; and FIG. 6 shows a front view of the paper sheet support surface.

Figure 1:
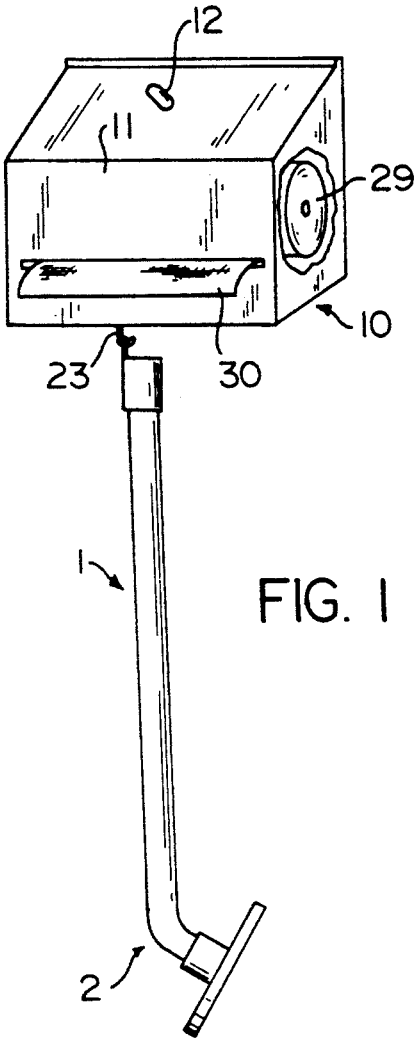
FIG. 1 shows the device according to the present finding.
Figure 2:
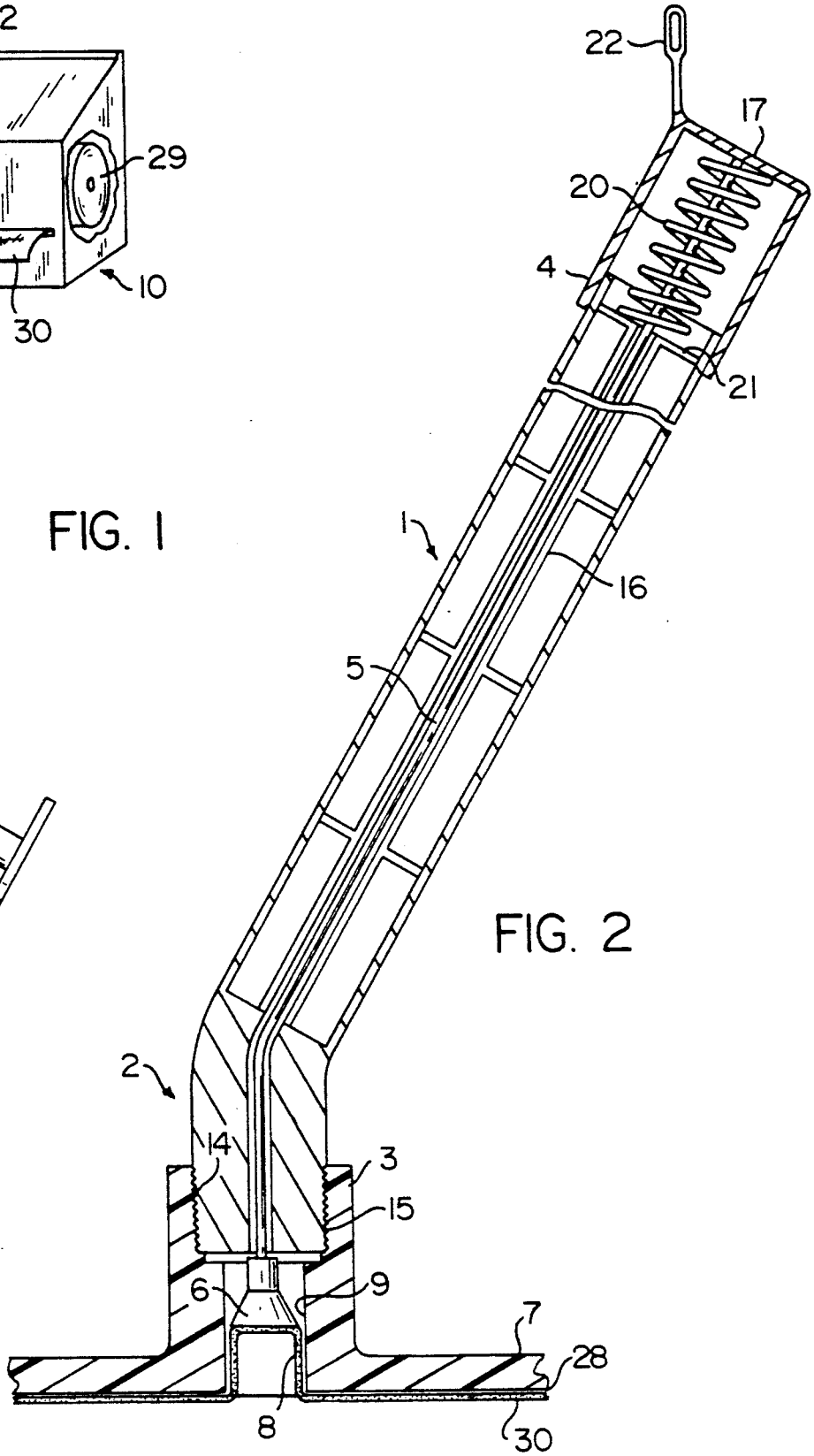
FIG. 2 shows a longitudinal sectional view of the device according to the present finding.

Referring first to FIGS. 1 and 2, the device according to the present invention is constituted by a tubular body (1) having an elbow-like bent cleaning end (2) and its other end provided with an eyelet 22 or another suitable hooking element in order to fasten said tubular body to the hook 23 of a support 10 fastened onto a wall by means of strips of double-face adhesive tape, or the like. A roll of paper or of another cleaning material 29, housed inside a container 10, is provided in order to supply sheets 30 of a paper material, separable by pulling thanks to transversal tearing perforations and which can be applied onto the cleaning device as illustrated in the following.

The structure of the device according to the present invention is illustrated in greater detail in the longitudinal sectional view of FIG. 2.

Such device comprises a tubular body 1 which is axially bored throughout its length, and has an elbow-like bent end 2 onto which a short cylindrical sleeve 3 is installed, which ends with a support flange 7 made of an elastically deformable material, and provided with a central opening 8 and with a hollow 9 in the bottom portion of the bore of the sleeve 3, all which are lined-up and substantially have a same diameter.

The sleeve 3 and the flange 7 are preferably made of rubber or of another elastomeric, or even plastic, material, obtained as an enblock piece by moulding, or by adhesive-bonding said two parts. Onto the flange 7, which preferably is of circular shape, the paper sheet 30 for surface cleaning, possibly folded twice or more times, is applied according to modalities as disclosed in the following. The sleeve 3 forms an angle of approximately 60° with the elongated portion of the tubular body 1, so as to facilitate the cleaning operation of surfaces with a whatever inclination. Such an angle may however be comprised within the range of from 30° to approximately 70°.

The sleeve 3 has its upper portion with a larger inner diameter than the hollow 9, in order to enable the elbow part 2 to be mounted. The sleeve can be forcedly slid onto the elbow end 2 or, as displayed in FIG. 2, it may be provided with an internal screw-threading 15 which gets engaged with a corresponding threaded portion 14 provided on the end 2.

As is better seen from FIG. 6, the surface of the support flange is preferably roughened by surface knurls or thin grooves and displays a certain number of radial grooves 28 which increase a certain number of radial grooves 28 which increase the adhesion of the sheet 30. Furthermore, a certain number of short radial notches 29A are provided around the central opening 8.

Inside the channel 16 defined inside the interior of the tubular body 1 a flexible organ 5 is housed, which is axially mobile along a certain stroke inside the interior of said tubular body 1. Said flexible organ 5 is preferably constituted by a spring steel wire capable of bending and following the bend of channel 16 at elbow 2. The flexible organ 5 is provided at one of its ends with an enlarged ejection portion 6, formed by a suction cup made of an elastomeric or plastomeric material, and at its other end, said flexible organ 5 is connected with a mobile portion formed by a sleeve 4 which is axially sliding along the tubular body 1, and with a closure plate 17 to which the end of said flexible metal wire 5 is fastened. A return spiral spring 20 is provided around the wire 5 and is retained by a shoulder 21 provided inside the interior of the tubular body 1.

In the operational configuration displayed in FIG. 1, the spring 20 is extended and the sucking-cup portion 6 which constitutes the ejection means stands in a back position inside the interior of the hollow 9.

Furthermore, a support 10 constitutes an integrating part of the device according to the present finding, which support 10 is such as to display a flat surface 11 from which a stud 12 juts out with a slightly shorter diameter than the transversal dimension of the opening 8 provided in the flange 7, and with a rounded end.

According to a preferred aspect shown in FIG. 1, such a support 10 makes a part of a container capable of housing a roll 29 of paper material which can be extracted through a slot and of which said element 11 constitutes a hinged, inclined cover. Of course, the surface 11 can be provided as a separate surface, for example as a prismatic element equipped with said stud 12, and anyway both said prismatic support and the container are preferably provided on their back side with wall fastening means, typically strips of a double-adhesive material. After the application onto a wall, the surface 11 results to be preferably inclined to the vertical by an angle of about 45°, or more generally, comprised within the range of from 25° to 65°.

The operating way of the device according to the invention is illustrated now by referring in particular to FIGS. 2–5.

Figure 3:
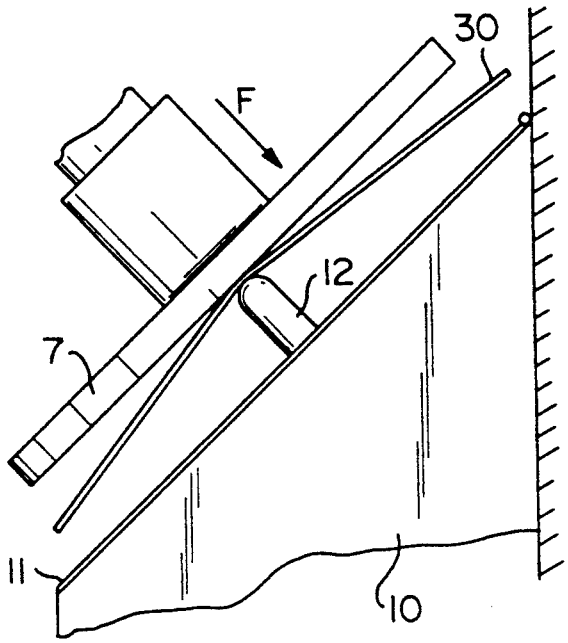
Figure 4:
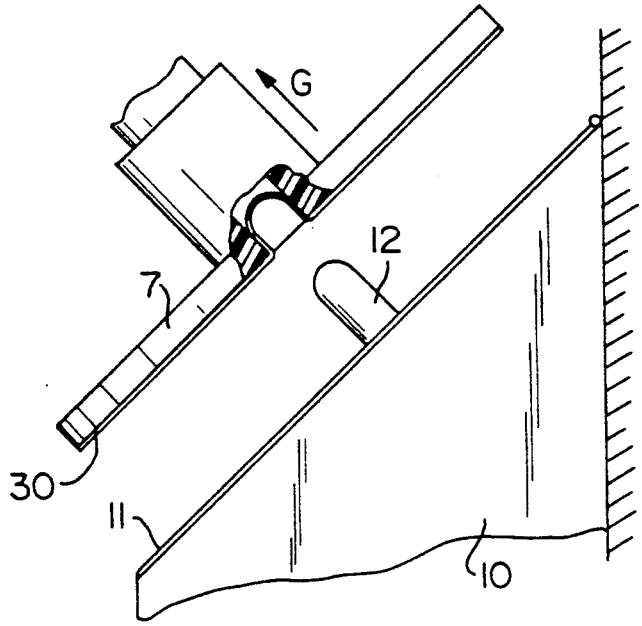
Figure 5:
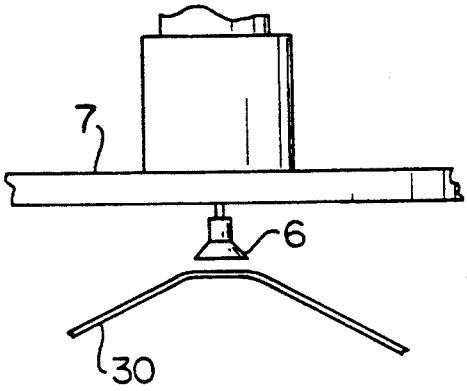

In order to clean a surface, the operator grasps the device with one of his hands, and with his other hand, he puts a paper sheet 30 (preferably folded twice or more times) onto the stud 12 of the support means, then superimposing the flange 7 onto the sheet 30, as shown in FIG. 3.

The operator presses then the device, in the direction indicated by the arrow F in FIG. 3, until the stud 12 and the overhanging portion of sheet 30 are caused to penetrate the bore 8. Then, by pulling the device back, in the opposite direction (arrow G in FIG. 4), the operator disengages the flange 7 from the stud 12, with the paper sheet remaining locked inside the bore 8 and then the operator can use the device in order to clean the desired surfaces.

When the cleaning operation is ended, or in order to replace the paper sheet used, it is enough that the operator axially pushes the portion 4 against the action exerted by the spring 20, in order to cause the sucking-cup ejection element 6 to move forward inside the bore 8 (see FIG. 5), thus causing the portion of paper locked inside the bore 8 to be expelled, and the device can then be stored, or the paper sheet can be replaced.

The spring 20 causes the sucking cup element 6 to return back to its resting position which element 6, thanks to its shape and to its elasticity, easily enters back the bore 8 without getting entangled inside the notches 29.

The length of the tubular body 1 is selected as a function of the type of application; however, of course, it is possible to provide one or more extension segments, which may be applied onto the straight end of said tubular body, in order to vary the useful length of the cleaning device.

The cleaning sheets 30 are made of a biodegradable and water-soluble material, preferably of paper with good absorbing properties or other cellulose-based products.

The scope of the instant finding is extended to encompass all the equivalent models which offer a same usefulness basing on the same innovative principle.

I claim:

1. An assembly for cleaning a surface, said assembly comprising:

a cleaning device comprising an elongated tubular body (1) with an axial bore, having on one end a bent elbow portion (2) and on the opposite end (3) a portion (4) which is movable relative to said tubular body; an elongated flexible organ (5) housed within the interior of said tubular body which is axially movable within said tubular body (1), said flexible organ having at one end an enlarged portion (6) and having its opposite end connected to said movable portion (4); said bent elbow portion (2) having an elastically deformable support flange (7) mounted thereon by means of a sleeve (3) which is integral with said elastically deformable support flange (7), said elastically deformable support flange having a central opening (8) which is aligned with a hollow interior portion (9) of said sleeve (3); and a support (10) adapted to cooperate with the cleaning device having a flat surface on which is mounted a stud (12) having a rounded end and which extends outwardly from said flat surface and has a diameter which is less than the diameter of said central opening (8) and said hollow interior portion (9) in said elastically deformable support flange (7), said flat surface and said stud operatively associated with said cleaning device to aid in mounting a sheet of cleaning material to said cleaning device.

2. An assembly according to claim 1, characterized in that said flexible organ (5) is made of spring steel wire and said enlarged portion comprises suction cup (6) which is made of one of the group consisting of an elastomeric and plastomeric material.

3. An assembly according to claim 1, characterized in that said movable portion (4) comprises a sleeve which is axially slidable along said tubular body (1) and is also provided with a closure plate which is connected to a return spring (20) that is provided between said movable portion (4) and said tubular body (1).

4. An assembly according to claim 1, characterized in that the surface of said elastically deformable support flange (7) which is opposite said tubular body (1) is roughened.

5. An assembly according to claim 4, characterized in that the surface of said elastically deformable support flange (7) which is opposite said tubular body (1) has radial grooves (28) and short radial notches (29) around central opening (8).

6. An assembly according to claim 1, characterized in that said elastically deformable support flange (7) is formed by coupling two discs of elastomeric material.

7. An assembly according to claim 1, characterized in that said sleeve (3) includes a tubular portion having internal threads (15) which are adapted to engage threads (14) on the external surface of said bent elbow portion (2).

8. An assembly according to claim 1, characterized in that said support (10) is a container having an inclined and hinged (11) cover having said flat surface, said container having on one surface adhesive fastening means and having within said container a roll of paper material.

9. An assembly according to claim 8, characterized in that the flat surface of said support (11) is inclined at approximately 45° relative to the surface which is provided with the adhesive fastening means.

10. An assembly according to claim 9, characterized in that said support (10) is provided with a hanger hook (23) for hanging said tubular body.

11. An assembly according to claim 1, characterized in that said elastically deformable flange (7) is substantially circular.

* * * * *